US011769975B1

(12) United States Patent
Groat

(10) Patent No.: US 11,769,975 B1
(45) Date of Patent: Sep. 26, 2023

(54) TERMINAL BLOCK LIGHT FIXTURE CONNECTION

(71) Applicant: CLAROLUX, Inc., Greensboro, NC (US)

(72) Inventor: Brian Groat, Greensboro, NC (US)

(73) Assignee: CLAROLUX, Inc., Greensboro, NC (US)

( * ) Notice: Subject to any disclaimer, the term of this patent is extended or adjusted under 35 U.S.C. 154(b) by 0 days.

(21) Appl. No.: 17/467,402

(22) Filed: Sep. 6, 2021

Related U.S. Application Data

(60) Provisional application No. 63/078,953, filed on Sep. 16, 2020, provisional application No. 63/075,428, filed on Sep. 8, 2020.

(51) Int. Cl.

| | |
|---|---|
| ***H01R 33/06*** | (2006.01) |
| ***F21V 23/06*** | (2006.01) |
| ***F21S 8/08*** | (2006.01) |

(52) U.S. Cl.
CPC ..... *H01R 33/06* (2013.01); *F21S 8/081* (2013.01); *F21V 23/06* (2013.01)

(58) Field of Classification Search
CPC ..... F21V 23/06; F21S 8/081; H01R 33/06
See application file for complete search history.

(56) References Cited

U.S. PATENT DOCUMENTS

| | | | | |
|---|---|---|---|---|
| 11,435,064 | B1 * | 9/2022 | Danesh | F21V 21/04 |
| 2013/0265780 | A1 * | 10/2013 | Choksi | F21V 29/74 362/373 |

* cited by examiner

*Primary Examiner* — Anabel Ton
(74) *Attorney, Agent, or Firm* — MacCord Mason PLLC

(57) ABSTRACT

Light fixture mounting system, assemblies, and devices are shown and described. In one embodiment, the lamp socket includes a pair of opposing terminal block inlet cavities and a pair of offset quick-connect mount chambers.

10 Claims, 5 Drawing Sheets

TERMINAL BLOCK LIGHT FIXTURE CONNECTION

This application claims the benefit of U.S. provisional application No. 63/075,428, filed Sep. 8, 2020; and U.S. provisional application No. 63/078,953, filed Sep. 16, 2020, both of which are incorporated herein by reference in their entireties.

FIELD OF THE TECHNOLOGY

The present disclosure relates generally to fixture supports, and more particularly to improved electrical terminal block and light fixture connection devices and assemblies.

SUMMARY

In accordance with the present disclosure, universal light fixture mounting systems and assemblies are provided for a wide variety of applications to secure a powered fixture about a surface, and the like. This disclosure provides improved assemblies and devices that are convenient, efficient, and safe for the user, particularly when used to directly deliver power to a socket and supporting a light fixture in a coupled position.

In one embodiment, a lamp socket includes a universal body having an upper engagement surface; a pair of opposing terminal block inlet cavities having a distal block in communication with a connection port aligned about the engagement surface; and a pair of offset connect mount chambers having a connection aperture aligned about the engagement surface.

In particular examples, the universal body comprises at least one mounting rail. The universal body may include a substantially hollow body. The terminal block inlet cavities may receive a power input. A fastening member may protrude from the connection port, for instance fixedly securing a power input about the terminal block. The terminal block inlet cavities may include a proximate block. The distal block may be substantially offset about the proximate block.

In certain examples, a fastening member protrudes from the connection port comprises a protruding fastener. The protruding fastener may include a screw type connection. The connection port may include internal receiving threads.

In particular examples, the power input may include a low voltage landscaping lighting cable. The landscape cable may directly deliver power about the terminal block inlet cavities. The landscape cable may directly deliver power about the socket free of a connector. The landscape cable may directly deliver power about the socket free of a heat shrink.

In certain examples, the device may include a partially exposed bottom. The pair of opposing terminal block inlet cavities and the pair of offset connect mount chambers may be aligned about the partially exposed bottom. The device may include a convex support aligned between a first terminal block inlet and a first connect mount chamber.

In particular examples, the first connect mount chamber separates the pair of opposing terminal block inlet cavities. The second connect mount chamber may be aligned on a reverse face of the pair of opposing terminal block inlet cavities. The connect mount chambers may have a connection aperture adapted to receive a lamp. The device may include a light fixture. The light fixture may include a bi-pin light fixture. The connection aperture may include secure a quick connect member. The connection aperture may secure a push-to-connect member. The connection aperture may be aligned radially about the mount chamber. The connection aperture may include socket springs, for instance mini socket springs.

In certain examples, the connection aperture comprises support plates. The connection aperture may include fasteners, for instance adjustable fasteners. The device may include a light fixture. The device a light fixture a support system.

In one embodiment, a lamp socket includes a universal body having an upper engagement surface; a pair of opposing terminal block inlet cavities adapted to receive a power input, and having a distal block in communication with a connection port aligned about the engagement surface; and a pair of offset quick-connect mount chambers having a connection aperture aligned about the engagement surface and adapted to receive a bi-pin lamp.

In particular examples, a landscape cable directly delivers power about the terminal block inlet cavities. The landscape cable may directly deliver power about the socket free of a connector. The landscape cable may directly deliver power about the socket free of a heat shrink.

In certain examples, the universal body comprises a partially exposed bottom. The pair of opposing terminal block inlet cavities and the pair of offset quick-connect mount chambers may be aligned about the partially exposed bottom. The universal body may comprise at least one mounting ground connection. The upper engagement surface may removably engage a light fixture. The device may include a first quick-connect mount chamber separates the pair of opposing terminal block inlet cavities. The device may include a second quick-connect mount chamber aligned on a reverse face of the pair of opposing terminal block inlet cavities.

In particular examples, the connection aperture secures a quick connect member. The connection aperture may secure a push-to-connect member. The opposing terminal block inlet cavities may include a distal block in communication with the proximate block. The landscape cable may directly deliver power about the terminal block inlet cavities.

In one embodiment, a universal connection assembly includes a power input; a pair of opposing terminal block inlet cavities receiving the power input and having a fastening member protruding from a connection port fixedly securing the power input about the terminal block; and a pair of offset quick-connect mount chambers having a connection aperture.

In particular examples, the opposing terminal block inlet cavities comprise a proximate block. The opposing terminal block inlet cavities may include a distal block in communication with the proximate block. The distal block may be aligned substantially offset about the proximate block. The fastening member protruding from the connection port may include a protruding fastener. The protruding fastener may include a screw type connection. The connection port may include internal receiving threads.

In certain examples, the power input comprises a low voltage landscaping lighting cable. The landscape cable may directly deliver power about the terminal block inlet cavities. The landscape cable may directly deliver power about the socket free of a connector. The landscape cable may directly deliver power about the socket free of a heat shrink.

In particular examples, the assembly comprises a partially exposed bottom. The pair of opposing terminal block inlet cavities and the pair of offset quick-connect mount chambers may be aligned about the partially exposed bottom. The assembly may include a convex support aligned between a first terminal block inlet and a first quick-connect mount chamber. The assembly may include a first quick-connect mount chamber separates the pair of opposing terminal block inlet cavities. The assembly may include a second quick-connect mount chamber aligned on a reverse face of the pair of opposing terminal block inlet cavities.

In one embodiment, a universal connection assembly includes a bi-pin light fixture; a pair of offset quick-connect mount chambers having a connection aperture receiving the bi-pin light fixture; and a pair of opposing terminal block inlet cavities having a distal block in communication with a connection port.

In particular examples, the connection aperture secures a quick connect member. The connection aperture may secure a push-to-connect member. The connection aperture may be aligned radially about the mount chamber. The connection aperture may include socket springs. The socket springs may include mini socket springs. The connection aperture may include support plates. The connection aperture may include fasteners. The fasteners may include adjustable fasteners. The assembly may include a first quick-connect mount chamber separates the pair of opposing terminal block inlet cavities. The assembly may include a second quick-connect mount chamber aligned on a reverse face of the pair of opposing terminal block inlet cavities. The assembly may include a partially exposed bottom. The pair of opposing terminal block inlet cavities and the pair of offset quick-connect mount chambers may be aligned about the partially exposed bottom. The assembly may include a convex support aligned between a first terminal block inlet and a first quick-connect mount chamber.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
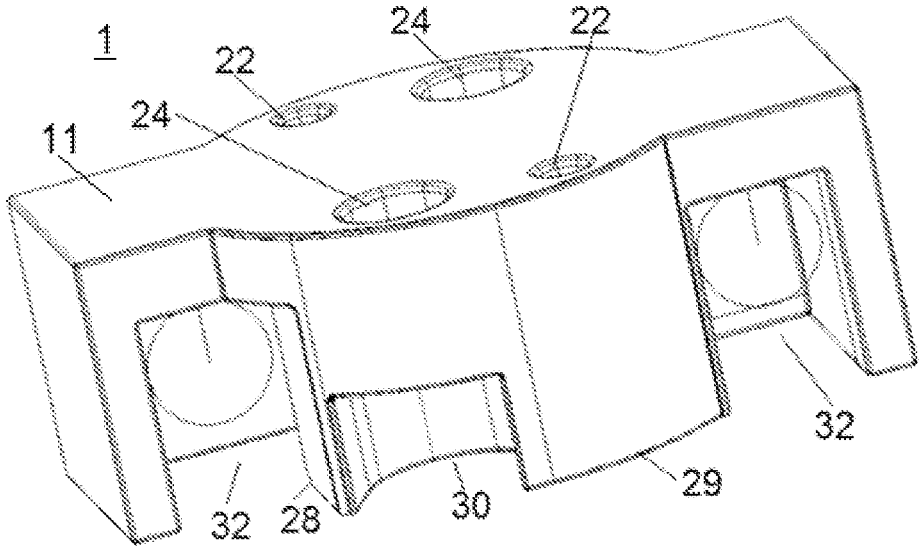
FIG. 1 is a top perspective view of one embodiment of a device according to the present disclosure, with elements removed for clarity.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 2:
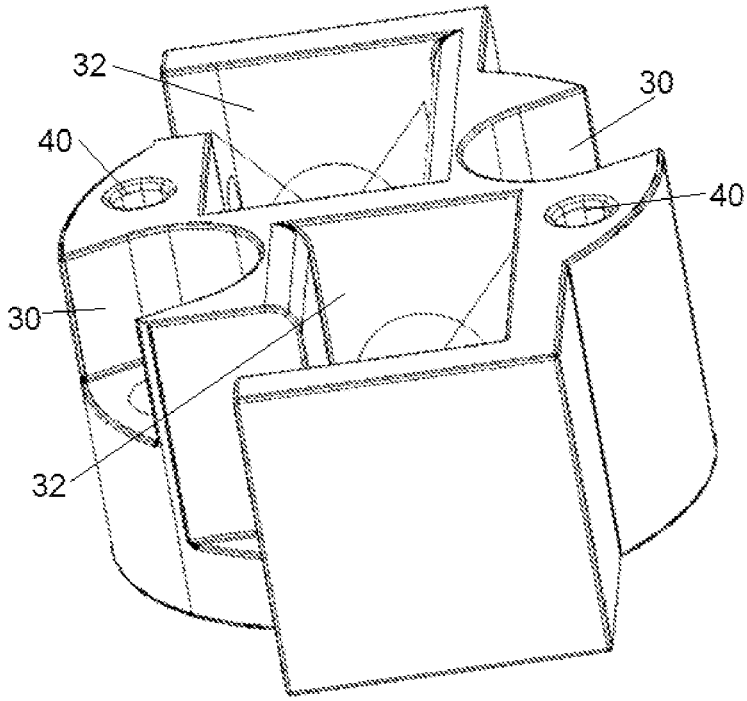
FIG. 2 is a side perspective view of the embodiment introduced in FIG. 1.
Figure 3:
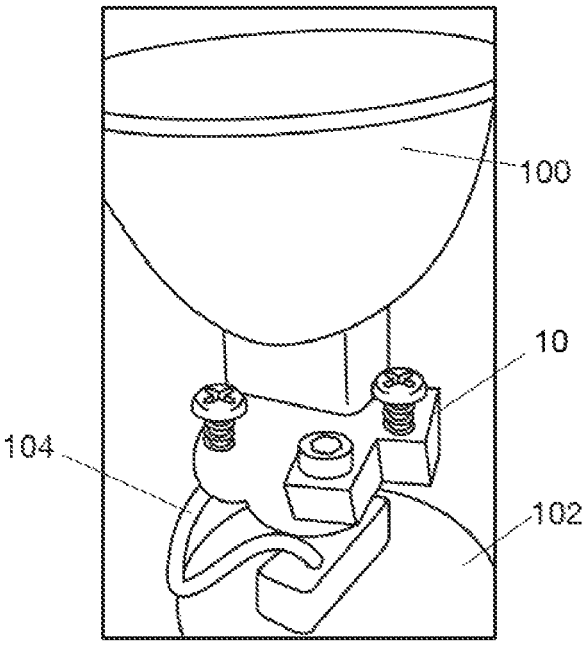
FIG. 3 is a side perspective view of an assembly with the embodiment introduced in FIG. 1.
Figure 4:
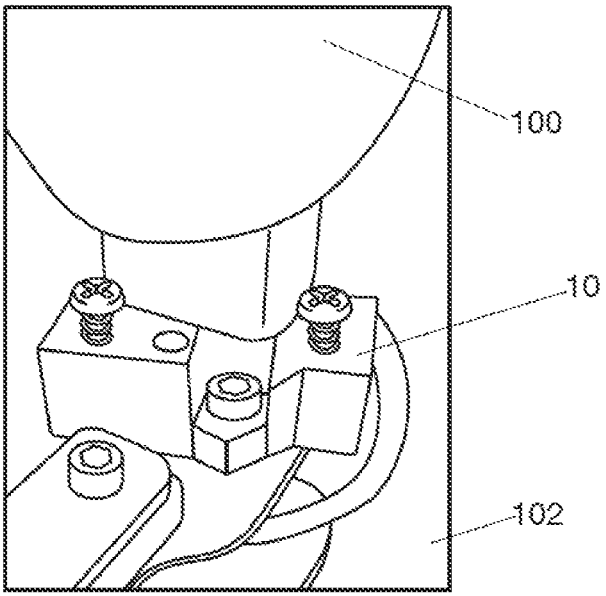
FIG. 4 is a side perspective view of an assembly with the embodiment introduced in FIG. 1.
Figure 5:
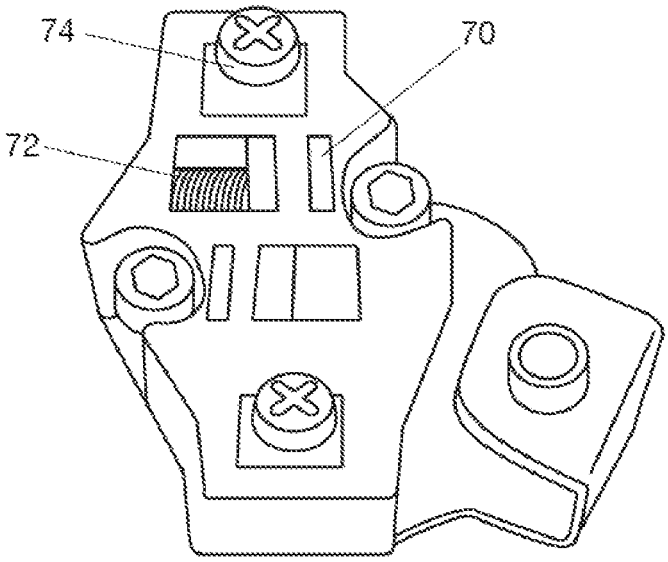
FIG. 5 is a top perspective view of an assembly with the embodiment introduced in FIG. 1, with elements removed for clarity.
Figure 6:
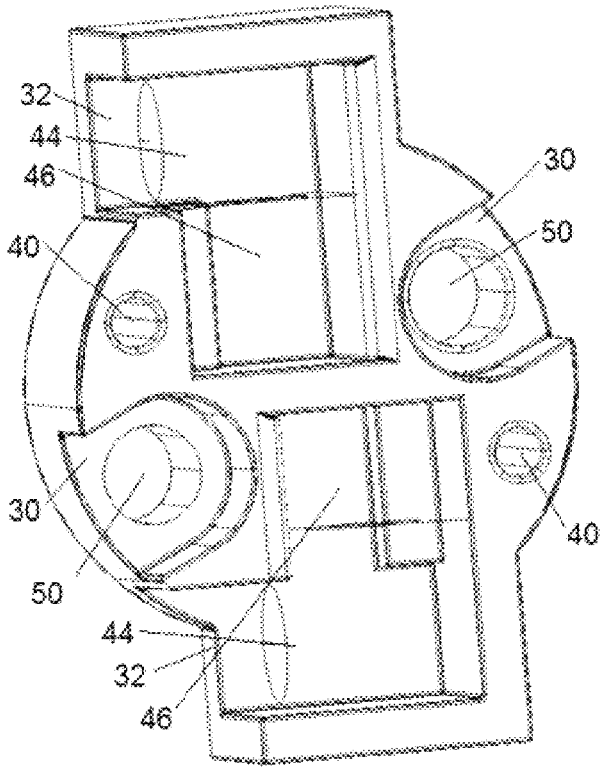
FIG. 6 is a side perspective view of the embodiment introduced in FIG. 1.
Figure 7:
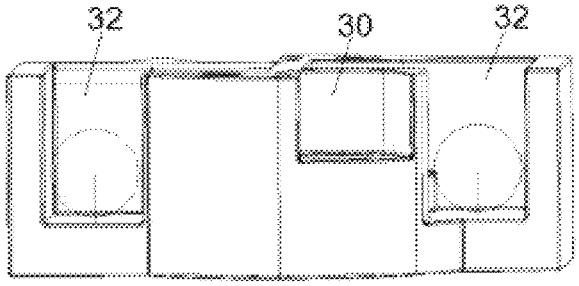
FIG. 7 is a side view of the embodiment introduced in FIG. 1.
Figure 8:
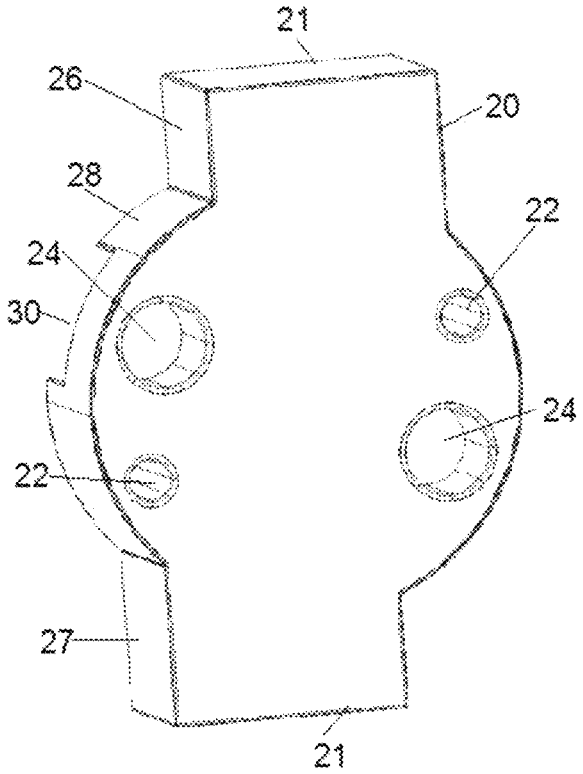
FIG. 8 is a top perspective view of the embodiment introduced in FIG. 1.
Figure 9:
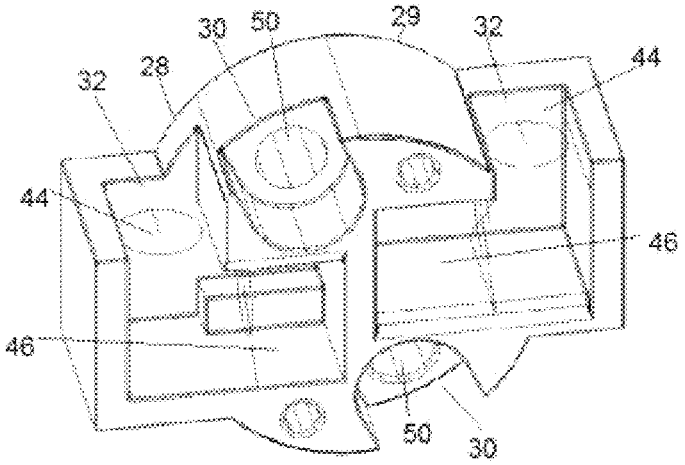
FIG. 9 is a side perspective view of the embodiment introduced in FIG. 1.

Referring now to the drawings in general and FIGS. 1 and 2 in particular, it will be understood that the illustrations are for the purpose of describing embodiments of the disclosure and are not intended to limit the disclosure or any inventions thereto. As seen in FIGS. 1-9, universal device and assemblies are shown embodied according to the present disclosure to secure a power input and a light fixture in a coupled operating position. Those skilled in the art having the benefit of this disclosure will recognize additional support features, lighting features, the like in combination with the universal mechanism.

In one embodiment, a universal lamp socket includes an upper engagement surface, however those skilled in the art having the benefit of this disclosure will recognize additional engagement positions and surfaces; a pair of opposing terminal block inlet cavities 32 having a distal block 46 in communication with a connection port 22 aligned about the engagement surface; and a pair of offset connect mount chambers 30 having a connection aperture 50 aligned about the engagement surface.

In particular examples, the universal body comprises at least one mounting rail, support, bracket, and the like. The universal body may include a substantially hollow body, including covers, shields, assembled portions, and the like. The terminal block inlet cavities may receive a power input 104, including any of the power supplies shown and described herein. A fastening member 74, or the like, may protrude from the connection port, for instance fixedly securing a power input about the terminal block. The terminal block inlet cavities may include a proximate block 44. The distal block 46 may be substantially offset about the proximate block 46.

In certain examples, a fastening member 74 protrudes from the connection port in the adjustable shape of a protruding fastener. The protruding fastener may include a screw type connection. The connection port may include internal receiving threads. However, those skilled in the art having the benefit of this disclosure will recognize additional fasteners and fastening supporting elements.

In particular examples, the power input 104 may include a low voltage landscaping lighting cable. The landscape cable may directly deliver power about the terminal block inlet cavities. Applicant has unexpectedly discovered the landscape cable may directly deliver power about the socket free of a connector, heat shrink, or similar element required by traditional systems.

In certain examples, the device may include a partially exposed bottom. The pair of opposing terminal block inlet cavities 32, 32 and the pair of offset connect mount chambers 30, 30 may be aligned about the partially exposed bottom. The device may include a convex support 29 aligned between a first terminal block inlet and a first connect mount chamber.

In particular examples, the first connect mount chamber 30 separates the pair of opposing terminal block inlet cavities 32,32. The second connect mount chamber may be aligned on a reverse face of the pair of opposing terminal block inlet cavities. The connect mount chambers may have a connection aperture adapted to receive a lamp 100. The device may removably position any light fixture shown and described in any arrangement, including removable arrangements. The light fixture may include a bi-pin light fixture. The connection aperture may include secure a quick connect member. The connection aperture may secure a push-to-connect member. The connection aperture may be aligned radially about the mount chamber. The connection aperture may include socket springs 72, for instance mini socket springs.

In certain examples, the connection aperture comprises support plates 70. The connection aperture may include fasteners, for instance adjustable fasteners. The device may include a light fixture. The device a light fixture a support system.

In one embodiment, a lamp socket includes a universal body 1 having an upper engagement surface 11; a pair of opposing terminal block inlet cavities 32 that generally receive a power input 104, and having a distal block 46 in communication with a connection port aligned about the engagement surface; and a pair of offset quick-connect mount chambers having a connection aperture 24 aligned about the engagement surface and adapted to receive any of the light fixtures shown and described herein.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

What is claimed is:

1. A lamp socket comprising:

a. a universal body having an upper engagement surface;

b. a pair of opposing terminal block inlet cavities adapted to receive a power input, and having a distal block in communication with a connection port aligned about said engagement surface; and c. a pair of offset quick-connect mount chambers having a connection aperture aligned about said upper engagement surface, and wherein a landscape cable directly delivers power about said terminal block inlet cavities.

2. The device of claim 1, wherein a landscape cable directly delivers power about said terminal block inlet cavities.

3. The device of claim 1, wherein a landscape cable directly delivers power about said terminal block inlet cavities.

4. The device of claim 1, wherein said universal body comprises at least one mounting ground connection.

5. The device of claim 1, wherein a first quick-connect mount chamber separates said pair of opposing terminal block inlet cavities.

6. The device of claim 1, wherein said connection aperture secures a quick connect member.

7. The device of claim 1, wherein said opposing terminal block inlet cavities comprise a distal block in communication with a proximate block.

8. A lamp socket comprising:

a. a universal body having an upper engagement surface;

b. a pair of opposing terminal block inlet cavities having a distal block in communication with a connection port aligned about said engagement surface; and c. a pair of offset connect mount chambers having a connection aperture aligned about said engagement surface.

9. The device of claim 8, including a fastening member protruding from said connection port fixedly securing a power input about said terminal block.

10. The device of claim 8, wherein said distal block aligned substantially offset about a proximate block.

* * * * *